US006634960B2

(12) United States Patent
Moriyama et al.

(10) Patent No.: US 6,634,960 B2
(45) Date of Patent: Oct. 21, 2003

(54) THREAD WOUND GOLF BALL

(75) Inventors: Keiji Moriyama, Kobe (JP); Kuniyasu Horiuchi, Kobe (JP); Akira Kato, Kobe (JP); Kazuhiko Isogawa, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/941,840

(22) Filed: Aug. 30, 2001

(65) Prior Publication Data

US 2002/0052250 A1 May 2, 2002

(30) Foreign Application Priority Data

Sep. 4, 2000 (JP) ..... 2000-267385

(51) Int. Cl.[7] ..... A63B 37/06
(52) U.S. Cl. ..... 473/357; 473/378
(58) Field of Search ..... 473/356, 357, 473/378, 383, 363

(56) References Cited

U.S. PATENT DOCUMENTS

| | | | | |
|---|---|---|---|---|
| 4,681,323 A | * | 7/1987 | Alaki et al. | 273/DIG. 22 |
| 5,653,648 A | * | 8/1997 | Thurman | 473/384 |
| 5,704,852 A | | 1/1998 | Kato et al. | |
| 5,704,853 A | * | 1/1998 | Maruko et al. | 473/351 |
| 5,792,008 A | * | 8/1998 | Kakiuchi et al. | 473/354 |
| 5,800,286 A | * | 9/1998 | Kakiuchi et al. | 473/365 |
| 5,823,888 A | * | 10/1998 | Maruko et al. | 273/DIG. 20 |
| 5,848,942 A | | 12/1998 | Kato | |
| 6,083,120 A | * | 7/2000 | Umezawa et al. | 473/356 |
| 6,210,291 B1 | | 4/2001 | Kato et al. | |

FOREIGN PATENT DOCUMENTS

| | | |
|---|---|---|
| GB | 2337935 | 12/1999 |
| JP | 9271537 | 10/1997 |
| JP | 2751022 | 2/1998 |
| JP | 10201881 | 8/1998 |
| JP | 2886804 | 2/1999 |
| JP | 200051400 | 2/2000 |

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a thread wound golf ball having long flight distance, while maintaining the characteristics peculiar to the conventional thread wound golf ball, i.e. good shot feel and excellent spin performance. The present invention related to a thread wound golf ball comprising a solid center, a thread rubber layer formed on the solid center, and a cover covering the thread rubber layer, of which the cover has many dimples on the surface thereof, wherein the solid center has a diameter of 35 to 38 mm and a deformation amount of not less than 0.5 mm to less than 1.5 mm when applying from an initial load of 9.8 N to a final load of 294 N, the cover has a Shore D hardness of 40 to 55, and a dimple volume rate and the cover hardness in Shore D hardness is adjusted to a specified range.

3 Claims, 1 Drawing Sheet

THREAD WOUND GOLF BALL

FIELD OF THE INVENTION

The present invention relates to a thread wound golf ball. More particularly, it relates to a thread wound golf ball having long flight distance, while maintaining the characteristics peculiar to the conventional thread wound golf ball, i.e. good shot feel and excellent spin performance.

BACKGROUND OF THE INVENTION

Many golf balls are commercially selling, but they are typically classified into solid golf balls such as two-piece golf ball, three-piece golf ball and the like, and thread wound golf balls. The solid golf ball consists of a solid core of molded rubber material and a cover of thermoplastic resin (e.g. ionomer resin) covering on the solid core. The thread wound golf ball consists of a solid or liquid center, a thread wound layer formed on the center and a cover of ionomer resin or balata etc. having a thickness of 1 to 2 mm covering on the thread wound layer.

The thread wound golf ball, when compared with the solid golf ball such as two-piece golf ball, has better shot feel at the time of hitting and better controllability at approach shot. The thread wound golf ball is generally approved of or employed by high level golfers, especially professional golfers, who regard the characteristics as most important. However, the thread wound golf ball is inferior in flight distance to the solid golf ball, because the thread wound golf ball has large spin amount and small launch angle.

In the thread wound golf balls, there are two types, such as one having a solid center formed from integrally molded rubber material and the other having a liquid center composed of a hollow rubber sphere and liquid encapsulated in the sphere. Among them, a thread wound golf ball with a liquid center and a balata (trans-polyisoprene) cover is particularly approved of or employed by high level golfers, especially professional golfers, because of good shot feel and excellent controllability at approach shot. The thread wound golf ball with a solid center, when compared with the thread wound golf ball comprising a liquid center, has excellent flight distance, because the rebound characteristics of the center also have an effect on the rebound characteristics of the golf ball itself. However, the thread wound golf ball is generally inferior in flight distance to the solid golf ball as described above, and it is required to improve the flight distance, while maintaining the characteristics peculiar to the thread wound golf ball.

In order to solve the problem, a thread wound golf ball with a solid center, which has further excellent shot feel and controllability and long flight distance mainly by adjusting physical properties of the solid center, such as a diameter, hardness and hardness distribution; and physical properties of the cover, such as a hardness and flexural modulus to suitable ranges, has been proposed in Japanese Patent Kokai Publication Nos. 271537/1997, 201881/1998 and 51400/2000, Japanese Patent No. 2751022 and the like. A thread wound golf ball with a solid center, of which dimple properties has been considered as the other factor with respect to the flight performance in addition to the physical properties of the solid center and cover, has been also proposed in Japanese Patent No. 2886804.

However, the thread wound golf ball, which has sufficient flight distance as same as solid golf balls, while maintaining the advantage of good shot feel and excellent controllability in the thread wound golf balls, has not been obtained. Therefore the thread wound golf ball having further excellent shot feel and controllability and long flight distance is required.

OBJECTS OF THE INVENTION

A main object of the present invention is to provide a thread wound golf ball, of which the flight distance is improved, while maintaining good shot feel and excellent spin performance.

According to the present invention, the object described above has been accomplished by adjusting a diameter and deformation amount of the solid center, and a hardness of the cover to a specified range, thereby providing a thread wound golf ball, of which an initial flight performance such as a launch angle and spin amount is optimized, while maintaining good shot feel and spin performance; and by adjusting a dimple volume ratio to a specific range in connection with the cover hardness, that is, by optimizing a trajectory in connection with the initial flight performance, thereby providing a thread wound golf ball, of which the flight distance is improved as long as possible, in a thread wound golf ball comprising a solid center.

SUMMARY OF THE INVENTION

Figure 1:
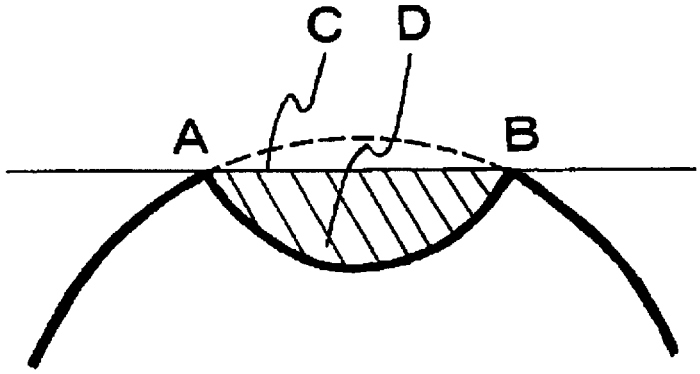
FIG. 1 is a schematic cross section of dimple of the golf ball of the present invention for explaining a dimple total volume.

The present invention provides a thread wound golf ball comprising a solid center, a thread rubber layer formed on the solid center, and a cover covering the thread rubber layer, of which the cover has many dimples on the surface thereof, wherein the solid center has a diameter of 35 to 38 mm and a deformation amount of not less than 0.5 mm to less than 1.5 mm when applying from an initial load of 9.8 N to a final load of 294 N, the cover has a Shore D hardness of 40 to 55, and a dimple volume rate $R_V$ (%) and the cover hardness ($C_D$) in Shore D hardness satisfy a correlation represented by the following formula (1):

$$36 \leqq (C_D \times R_V) \leqq 42 \quad (1)$$

wherein the dimple volume rate $R_V$ is represented by the following formula:

$$R_V(\%) = V_T / V_G \times 100$$

wherein $V_T$ ($mm^3$) is a dimple total volume, which is the sum of a volume of a space defined by a concave of the dimple and a tangent plane passed through an opening of the dimple, and $V_G$ is a volume of the golf ball assuming that it is a true sphere having no dimples on the surface thereof.

In order to put the present invention into a more suitable practical application, it is desired that the solid center have a surface hardness ($S_D$) in Shore D hardness of 48 to 60, and the surface hardness of the solid center ($S_D$), the cover hardness ($C_D$) and the dimple total volume $V_T$ ($mm^3$) satisfy a correlation represented by the following formula (2):

$$0.67 \leqq (C_D \times R_V)/S_D \leqq 0.79 \quad (2)$$

The present invention consists of the following four requisites, and technical effects thereof are as follows.

(i) A spin amount of the resulting golf ball is decreased by adjusting a diameter of the solid center to the range of 35 to 38 mm, which is large.

(ii) A hardness of the solid center of the resulting golf ball is increased by adjusting a deformation amount of the solid center when applying from an initial load of 9.8 N to a final load of 294 N to the range of not less than 0.5 mm and less than 1.5 mm, which is small. Thereby a hardness of the resulting golf ball is also high, and it is possible to decrease an extension of a thread rubber when winding the thread rubber. Therefore the resulting golf ball has good shot feel.

(iii) A spin amount when hit by a driver to long iron club at high head speed such that a deformation reaches to the solid center is decreased by adjusting a cover hardness in Shore D hardness ($C_D$) to the range of 40 to 55. In addition, a spin performance when hit by a short iron club to at approach shot at low head speed such that a deformation reaches only to the surface of the golf ball is improved.

(iv) It is possible to impart the most suitable trajectory to the golf ball having the initial flight performance, such as ball velocity, launch angle and spin amount obtained by the (i) to (iii) by adjusting the dimple volume rate $R_V$ (%) and the cover hardness ($C_D$) in Shore D hardness to a specified range such that the $R_V$ (%) and $C_D$ satisfy a correlation represented by the following formula (1):

$$36 \leqq (C_D \times R_V) \leqq 42 \quad (1)$$

wherein the dimple volume rate $R_V$ is represented by the following formula:

$$R_V(\%) = V_T / V_G \times 100$$

wherein $V_T$ ($mm^3$) is a dimple total volume, which is the sum of a volume of a space defined by a concave of the dimple and a tangent plane passed through an opening of the dimple, and $V_G$ is a volume of the golf ball assuming that it is a true sphere having no dimples on the surface thereof. The trajectory is optimized by adjusting dimple properties to a proper range, because the cover hardness has an effect on the spin performance. Therefore it is possible to improve the flight performance as much as possible.

The term "total dimple volume" as used herein will be explained with reference to FIG. 1. FIG. 1 is a schematic cross section of the dimple for explaining a total dimple volume. The dimple total volume is the sum of the volume of each dimple, and the dimple volume is a volume of a space defined by a concave of the dimple and a tangent plane C passed through an opening of the dimple AB.

DETAILED DESCRIPTION OF THE INVENTION

The thread wound golf ball of the present invention will be explained in detail hereinafter. The golf ball of the present invention comprises a solid center, a thread rubber layer formed on the solid center and a cover formed on the thread rubber layer. The solid center is formed from a rubber composition comprising a base rubber, a co-crosslinking agent, organic peroxide, filler and the like.

The base rubber may be natural rubber and/or synthetic rubber, which has been conventionally used for solid golf balls. Preferred is high-cis polybutadiene rubber containing a cis-1,4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

Examples of the co-crosslinking agents include a metal salt of α,β-unsaturated carboxylic acid, particularly mono- or di-valent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent may be 10 to 40 parts by weight, preferably 15 to 35 parts by weight, based on 100 parts by weight of the base rubber. When the amount of the co-crosslinking agent is larger than 40 parts by weight, the center is too hard, and the shot feel of the resulting golf ball is poor. On the other hand, when the amount of the co-crosslinking agent is smaller than 10 parts by weight, the center is too soft, and the rebound characteristics of the resulting golf ball are degraded, which reduces the flight distance.

Examples of the organic peroxides, which acs as a crosslinking agent or hardener, include dicumyl peroxide, 1,1-bis(t-butylperoxy)-3,3,5-trimethylcyclohexane, 2,5-dimethyl-2,5-di(t-butylperoxy)-hexane, di-t-butyl peroxide and the like. The preferred organic peroxide is dicumyl peroxide. The amount of the organic peroxide is from 0.5 to 2.0 parts by weight, preferably 0.8 to 1.5 parts by weight, based on 100 parts by weight of the base rubber. When the amount of the organic peroxide is smaller than 0.5 parts by weight, the center is too soft, and the rebound characteristics are degraded, which reduces the flight distance. On the other hand, when the amount of the organic peroxide is larger than 2.0 parts by weight, the center is too hard, and the shot feel is poor.

Examples of the fillers, which can be used for the core of the golf ball, include for example, inorganic filler (such as zinc oxide, barium sulfate, calcium carbonate, and the like), high specific gravity metal powder filler (such as tungsten powder, molybdenum powder, and the like), and the mixture thereof. The amount of the filler in the inner center 1 is from 20 to 70 parts by weight, preferably 25 to 60 parts by weight, based on 100 parts by weight of the base rubber. When the amount of the filler is smaller than 20 parts by weight, the center is too light, and the weight of the resulting golf ball is too small. On the other hand, when the amount of the filler is larger than 70 parts by weight, the center is too heavy, and the weight of the resulting golf ball is too large.

In the golf ball of the present invention, the rubber composition for the solid center can contain other components, which have been conventionally used for preparing the core of solid golf balls, such as antioxidant or peptizing agent. If used, the amount of the antioxidant is preferably 0.2 to 0.5 parts by weight, based on 100 parts by weight of the base rubber.

The solid center is obtained by mixing the rubber composition using a proper mixer such as a kneader and a mixing roll, followed by vulcanizing and press-molding the mixture in a mold. The vulcanization condition is not limited as long as the solid center has the following characteristics, but the vulcanization may be conducted at 130 to 240° C. and 2.9 to 11.8 MPa for 15 to 60 minutes. The vulcanizing may be conducted in two or more stages of the temperature.

In the golf ball of the present invention, it is required for the solid center to have a diameter of 35 to 38 mm, preferably 35 to 37 mm, more preferably 35.5 to 36.5 mm. When the diameter of the solid center is smaller than 35 mm, the spin amount at the time of hitting increases, which reduces the flight distance. On the other hand, when the diameter of the solid center is larger than 38 mm, the thread rubber layer is too thin, and good shot feel peculiar to thread wound golf ball is not sufficiently obtained.

In the golf ball of the present invention, it is required for the solid center to have a deformation amount of the solid center when applying from an initial load of 9.8 N to a final load of 294 N of not less than 0.5 mm and less than 1.5 mm, preferably 0.7 to 1.4 mm, more preferably 1.0 to 1.4 mm. When the deformation amount is smaller than 0.5 mm, spin amount of the resulting golf ball is high, which reduces flight distance. On the other hand, when the deformation amount is not less than 1.5 mm, ball hardness is not sufficiently obtained, because the diameter of the solid center is also large. Therefore it is required to increase an extension of a thread rubber when winding the thread rubber, and the shot feel is poor.

In the golf ball of the present invention, it is desired for the solid center to have a surface hardness in Shore D hardness of 48 to 60, preferably 50 to 60, more preferably 53 to 58. When the hardness is smaller than 48, the solid center is too soft, and rebound characteristics of the resulting golf ball are degraded. On the other hand, when the hardness is larger than 60, the solid center is too hard, and the shot feel of the resulting golf ball is poor. In addition, the spin amount is also high, which reduces the flight distance. The thread rubber layer is then formed on the solid center.

The thread rubber used for winding around the solid center may be of the same kind which is conventionally used in thread wound layers in thread wound golf balls; e.g., it can be obtained by vulcanizing a rubber composition in which natural rubber or natural rubber and synthetic polyisoprene have been compounded with sulfur, a vulcanization aid, vulcanization accelerator, antioxidant and the like. The thread rubber layer is formed on the solid center by conventional methods which have used for preparing the thread wound core of the thread wound golf balls. The thread rubber layer has a thickness of 1.0 to 2.5 mm, preferably 1.0 to 2.0 mm. When the thickness of the thread rubber layer is smaller than 1.0 mm, the thread rubber layer is too thin to exhibit sufficient impact relaxation, and the shot feel is poor. On the other hand, when the thickness is larger than 2.5 mm, the spin amount at the time of hitting increases, which reduces the flight distance. The cover is then formed on the thread rubber layer.

In the golf ball of the present invention, it is required for the cover to have a Shore D hardness of 40 to 55, preferably 46 to 54. When the hardness is smaller than 40, the spin performance when hit by a short iron club to at approach shot at low head speed such that a deformation reaches only to the surface of the golf ball is improved, but the spin amount when hit by a driver to long iron club at high head speed such that a deformation reaches to the solid center is increased, which reduces the flight distance. On the other hand, when the hardness is larger than 55, the spin amount when hit by a short iron club to at approach shot at low head speed such that a deformation reaches only to the surface of the golf ball is too low, and the spin performance is degraded.

In the golf ball of the present invention, it is desired for the cover to be formed from a base resin mainly comprising ionomer resin. The ionomer resin used in the present invention is not limited, but includes a copolymer of ethylene and α,β-unsaturated carboxylic acid, of which at least a portion of carboxylic acid groups is neutralized with metal ion; a terpolymer of ethylene, α,β-unsaturated carboxylic acid and α,β-unsaturated carboxylic acid ester, of which at least a portion of carboxylic acid groups is neutralized with metal ion; or mixtures thereof. Examples of the α,β-unsaturated carboxylic acid in the ionomer, for example, include acrylic acid, methacrylic acid, fumaric acid, maleic acid, crotonic acid and the like. Preferred are acrylic acid and methacrylic acid. Examples of the α,β-unsaturated carboxylic acid ester in the ionomer, for example, include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. Examples of the metal ions, which neutralizes a portion of carboxylic acid groups of the copolymer or terpolymer, include a sodium ion, a potassium ion, a lithium ion, a magnesium ion, calcium ion, a zinc ion, a barium ion, an aluminum ion, a tin ion, a zirconium ion, a cadmium ion and the like. Preferred are sodium ion, zinc ion, magnesium ion and the like, in view of rebound characteristics, durability and the like.

The ionomer resin is not limited, but examples thereof will be shown by trade names. Examples of the ionomer resin, which is commercially available from Du Pont-Mitsui Polychemicals Co., Ltd., include Hi-milan 1555, Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which is commercially available from Du Pont Co., include Surlyn 8140, Surlyn 9120, Surlyn 8945, Surlyn 9945, Surlyn AD8511, Surlyn AD8512, Surlyn AD8542, Surlyn 6320 and the like. Examples of the ionomer resin, which is commercially available from Exxon Chemical Co., include Iotek 7010, Iotek 8000, and the like. The ionomers may each be used alone or in combinations of two or more.

As the materials suitably used in the cover of the present invention, the above ionomer resin may be used alone, but the ionomer resin may be used in combination with at least one of thermoplastic elastomer, diene block copolymer and the like.

Examples of the thermoplastic elastomers include polyamide thermoplastic elastomer, which is commercially available from Toray Co., Ltd. under the trade name of "Pebax" (such as "Pebax 2533"); polyester thermoplastic elastomer, which is commercially available from Toray-Do Pont Co., Ltd. under the trade name of "Hytrel" (such as "Hytrel 3548", "Hytrel 4047"); polyurethane elastomer, which is commercially available from Takeda Bardishe Co., Ltd. under the trade name of "Elastollan" (such as "Elastollan ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010"), the diene block copolymers, which are commercially available from Kuraray Co., Ltd. under the trade name of "Septon" (such as "Septon HG-252") and the like.

The amount of the thermoplastic elastomer or diene block copolymer is 0 to 60 parts by weight, preferably 10 to 40 parts by weight, based on 100 parts by weight of the base resin for the cover. When the amount is larger than 60 parts by weight, the cover is too soft and the rebound characteristics are degraded, or the compatibility with the ionomer resin is degraded and the durability is degraded.

In the golf ball of the present invention, the resin composition for the cover may optionally contain the same fillers as used in the solid center, pigments (such as titanium dioxide, etc.), and the other additives (such as dispersants, antioxidants, UV absorbers, photostabilizers and fluorescent agents or fluorescent brighteners, etc.), in addition to the resin component, as long as the addition of the additives does not deteriorate the desired performance of the golf ball cover, but an amount of the pigment is preferably from 1.0 to 6.0 parts by weight based on 100 parts by weight of the cover base resin.

The cover of the present invention may be formed by conventional methods, which have been known to the art and used for forming the cover of the golf balls. For example, there can be used a method comprising molding the cover composition into a semi-spherical half-shell in advance, covering the thread wound core with the two half-shells, followed by pressure molding at 130 to 170° C. for 1 to 5 minutes, or a method comprising injection molding the cover composition directly on the thread wound core to cover it.

It is desired for the cover to have a thickness of 0.5 to 3.0 mm, preferably 1.0 to 2.0 mm, more preferably 1.5 to 2.0 mm. When the thickness of the cover is smaller than 0.5 mm, the cover is too thin, and the durability is degraded and the rebound characteristics are degraded. On the other hand, when the thickness is larger than 3.0 mm, the shot feel is poor.

At the time of molding the cover, many depressions called "dimples" are formed on the surface of the golf ball. In the golf ball of the present invention, it is required that a dimple volume rate $R_V$ (%) and the cover hardness ($C_D$) in Shore D hardness satisfy a correlation represented by the following formula (1):

$$36 \leqq (C_D \times R_V) \leqq 42 \quad (1)$$

wherein the dimple volume rate Rv is represented by the following formula:

$$R_V(\%) = V_T / V_G \times 100$$

wherein $V_T$ ($mm^3$) is a dimple total volume, which is the sum of a volume of a space defined by a concave of the dimple and a tangent plane passed through an opening of the dimple, and $V_G$ is a volume of the golf ball assuming that it is a true sphere having no dimples on the surface thereof, the product ($C_D \times R_V$) is preferably within the range of 36 to 40. When the product ($C_D \times R_V$) is smaller than 36, the resulting golf ball creates blown-up trajectory, which reduces the flight distance. On the other hand, when the product ($C_D \times R_V$) is larger than 42, the trajectory of the resulting golf ball is easy to drop, which reduces the flight distance.

In the golf ball of the present invention, the trajectory is proper and the flight distance is long, when the $R_V$ and $C_D$ satisfy a correlation represented by the following formula (1):

$$36 \leqq (C_D \times R_V) \leqq 42 \quad (1)$$

Even if the $R_V$ and $C_D$ are within the above range, the trajectory of the golf ball easy to drop with increasing the product ($C_D \times R_V$) and the golf ball easy to create blown-up trajectory with decreasing the product ($C_D \times R_V$) Therefore, it is desired to optimize the trajectory by adjusting the spin amount, thereby improving the flight distance. When the product is large, the trajectory of the golf ball is prevented from dropping by increasing the surface hardness of the solid center to increase the spin amount. On the other hand, when the product is small, the golf ball is prevented from creating blown-up trajectory by decreasing the surface hardness of the solid center to decrease the spin amount. Thereby the trajectory is proper, and the flight distance is improved.

Therefore, in the golf ball of the present invention, it is desired that the surface hardness of the solid center ($S_D$), the cover hardness ($C_D$) and the dimple volume rate $R_V$ (%) satisfy a correlation represented by the following formula (2):

$$0.67 \leqq (C_{D \times RV})/S_D \leqq 0.79 \quad (2)$$

the quotient [($C_D \times R_V$)/$S_D$] is preferably 0.68 to 0.78, more preferably 0.68 to 0.74. When the [($C_D \times R_V$)/$S_D$] is smaller than 0.67, the trajectory is high, which reduces the flight distance. On the other hand, when the [($C_D \times R_V$)/$S_D$] is larger than 0.79, the trajectory is low, which reduces the flight distance.

Furthermore, paint finishing or marking with a stamp may be optionally provided after the cover is molded for commercial purposes.

EXAMPLES

The following Examples and Comparative Examples further illustrate the present invention in detail but are not to be construed to limit the scope of the present invention.

Production of Solid Center

Each spherical solid center having a diameter of 35.8 mm was obtained by mixing the rubber composition for the solid center having the formulation shown in Table 1, and press-molding the mixture at 160° C. for 23 minutes. A deformation amount and surface hardness of the resulting solid center were measured. The results are shown in Tables 3 and 4.

TABLE 1

| | (parts by weight) | | |
|---|---|---|---|
| Solid center composition | A | B | C |
| BR18*1 | 100 | 100 | 100 |
| Zinc acrylate | 28 | 35 | 39 |

TABLE 1-continued

| Solid center composition | (parts by weight) A | B | C |
|---|---|---|---|
| Dicumyl peroxide | 1.1 | 1.1 | 1.1 |
| Zinc oxide | 15.3 | 13.1 | 11.9 |
| Barium sulfate | 20 | 20 | 20 |
| Diphenyl disulfide | 0.5 | 0.5 | 0.5 |

*1High-cis polybutadiene (trade name "BR 18") from JSR Co., Ltd., Content of 1,4-cis-polybutadiene: 96%

Formation of Thread Rubber Layer

Each thread rubber layer having a width of 1.5 mm and thickness of 0.5 mm was then formed on the solid center by winding the thread rubber to obtain each thread wound core having a diameter of 38.95 mm (a thickness of the thread rubber of 1.575 mm). The thread rubber was prepared from a blend of natural rubber and a low cis-isoprene rubber ("Shell IR-309" commercially available from Shell Chemical Co., Ltd.) =50/50 (weight ratio).

Preparation of Cover Composition

The formulation materials for the cover shown in Table 2 were mixed using a kneading type twin-screw extruder to obtain pelletized cover compositions. The extrusion condition were a screw diameter of 45 mm, a screw speed of 200 rpm, and a screw L/D of 35.

The formulation materials were heated at 200 to 260° C. at the die position of the extruder. The Shore D hardness of the resulting cover compositions was measured, and the result is shown in Tables 3 and 4. The Shore D hardness was determined according to ASTM D-2240, using a sample of a stack of the three or more heat and press molded sheets having a thickness of about 2 mm from the each composition, which had been stored at 23° C. for 2 weeks.

TABLE 2

| Cover composition | | (parts by weight) a | b | c | d |
|---|---|---|---|---|---|
| Surlyn 8945 | *2 | 25 | 30 | 33 | 37 |
| Surlyn 9945 | *3 | 25 | 30 | 33 | 37 |
| Septon HG-252 | *4 | 35 | 30 | 25 | 18 |
| Epofriend A1010 | *5 | 15 | 10 | 9 | 8 |
| Titanium dioxide | | 4 | 4 | 4 | 4 |
| Sanol LS770 | *6 | 2 | 2 | 0.2 | 0.2 |

*2Surlyn 8945 (trade name), ethylene-methacrylic acid copolymer ionomer resin obtained by neutralizing with sodium ion, manufactured by Du Pont Co., Shore D hardness =

*3Surlyn 9945 (trade name), ethylene-methacrylic acid copolymer ionomer resin obtained by neutralizing with zinc ion, manufactured by Du Pont Co., Shore D hardness = 59

*4Cepton HG-252 (trade name), hydrogenated styrene-isoprene-styrene block copolymer having a terminal OH group, manufactured by Kuraray Co., Ltd., JIS-A hardness = 80, content of styrene = about 40% by weight

*5Epofriend A1010 (trade name), styrene-butadiene-styrene structure block copolymer having a polybutadiene block with epoxy groups, manufactured by Daicel Chemical Industries, Ltd., styrene/butadiene (weight ratio) = 40/60, JIS-A hardness = 70, content of epoxy: about 1.5 to 1.7% by weight

*6Sanol LS770 (trade name), antioxidant, manufactured by Sankyo Co., Ltd.

Examples 1 to 7 and Comparative Examples 1 to 3

Figure 2:
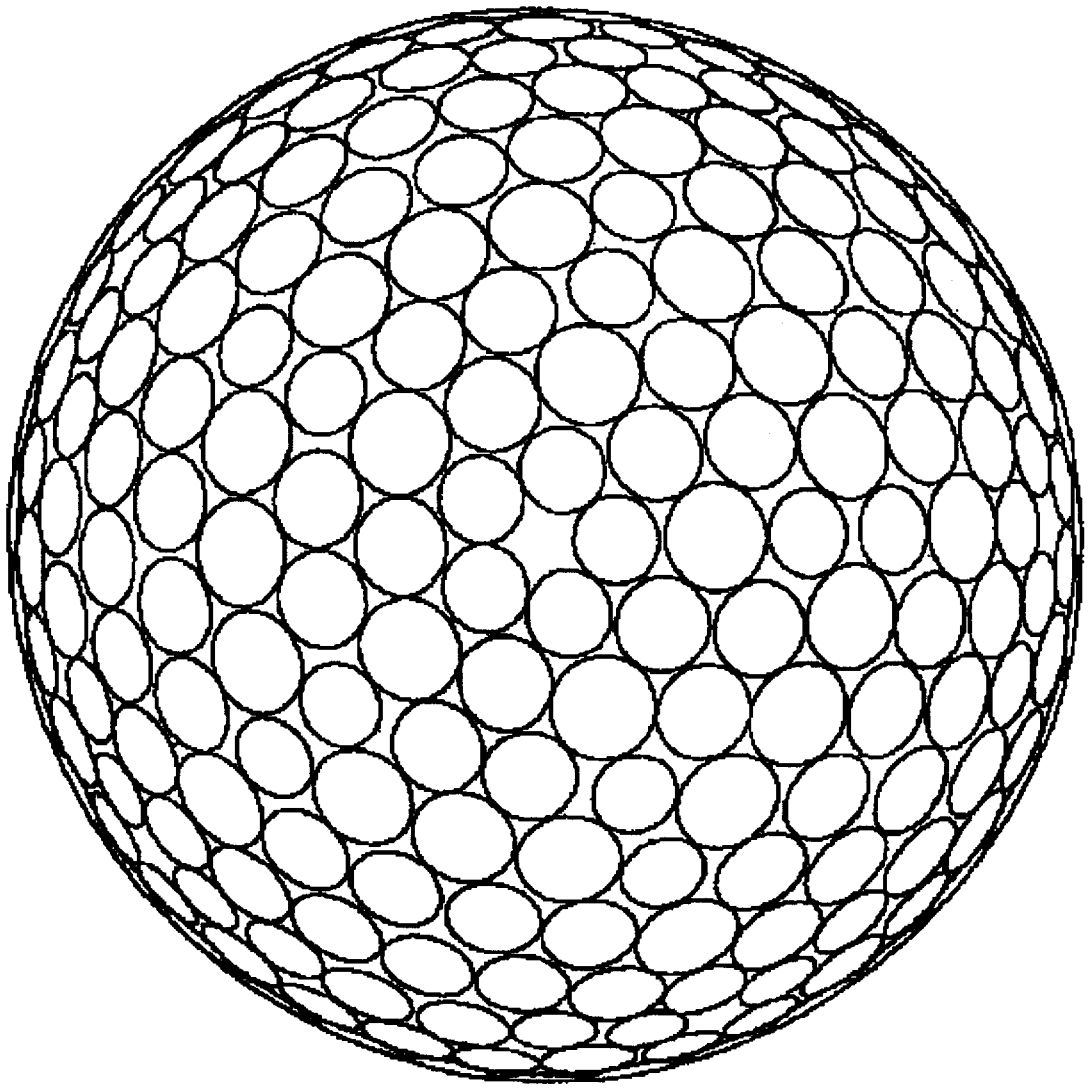
FIG. 2 is a schematic perspective illustrating the arrangement of dimples of the golf ball of Examples of the present invention.

The resulting cover compositions were preliminary molded into semi-spherical half-shells, encapsulating the resulting thread wound core with the two half-shells, followed by press-molding in the mold having dimples for golf ball and then coating with a paint to obtain a thread wound golf ball having a diameter of 42.75 mm (thickness of the cover layer of 1.9 mm). The number of dimples is 410 in all golf balls, each golf ball has dimples having four kinds of diameter, and all golf balls have the same arrangement of dimples. In FIG. 2, a schematic perspective illustrating the arrangement of dimples is shown. The thread wound golf balls having four kinds of dimple volume rate (0.709, 0.758, 0.856 and 0.904%) were obtained by selecting a dimple depth. With respect to the resulting golf ball, a launch angle, spin amount, trajectory elevation angle and flight distance as flight performance were measured, and the results are shown in Tables 3 and 4. The test methods are as follows.

Test Methods (1) Deformation amount of the solid center

The deformation amount of the solid center is determined by measuring a deformation amount of the solid center when applying from an initial load of 9.8 N to a final load of 294 N.

(2) Flight Performance 1

After a No. 1 wood club (a driver, W#1; "XXIO" loft angle=8 degrees, X shaft, manufactured by Sumitomo Rubber Industries, Ltd.) having metal head was mounted to a swing robot manufactured by Golf Laboratory Co. and a golf ball was hit at head speed of 50 m/sec, the launch angle, spin amount (backspin), trajectory elevation angle and flight distance were measured. As the flight distance, total that is a distance to the stop point of the hit golf ball was measured. The trajectory elevation angle was determined by measuring an angle made with the horizontal by a straight line, which passes through the peak of the trajectory and an observation point at hitting point. The measurement was conducted 12 times for each golf ball (n=12), and the average is shown as the result of the golf ball.

(2) Flight Test 2

After a sand wedge (SW; "DP-601", manufactured by Sumitomo Rubber Industries, Ltd.) was mounted to a swing robot manufactured by Golf Laboratory Co. and a golf ball was hit at head speed of 21 m/sec, the spin amount (backspin) was measured. The measurement was conducted 12 times for each golf ball (n=12), and the average is shown as the result of the golf ball.

TABLE 3

| Test item | Example No. 1 | 2 | 3 | 4 | 5 |
|---|---|---|---|---|---|
| (Solid center) | | | | | |
| Composition | A | B | C | A | A |
| Deformation amount (mm) | 1.36 | 1.01 | 0.78 | 1.36 | 1.36 |
| Surface hardness $S_D$ (Shore D) | 53 | 58 | 60 | 53 | 53 |
| (Cover) | | | | | |
| Composition | a | a | a | a | b |
| Shore D hardness ($C_D$) | 46 | 46 | 46 | 46 | 51 |
| (Golf ball) | | | | | |
| Dimple total volume $V_T$ ($mm^3$) | 350 | 350 | 350 | 370 | 310 |
| Dimple volume rate $R_V$ (%) | 0.856 | 0.856 | 0.856 | 0.904 | 0.758 |
| ($C_D \times R_V$) | 39.4 | 39.4 | 39.4 | 41.6 | 38.7 |
| ($C_D \times R_V$)/$S_D$ | 0.74 | 0.68 | 0.66 | 0.78 | 0.73 |

TABLE 3-continued

| Test item | Example No. 1 | 2 | 3 | 4 | 5 |
|---|---|---|---|---|---|
| Flight performance (1) | | | | | |
| Launch angle L (degree) | 10.2 | 10.0 | 9.9 | 10.2 | 10.5 |
| Spin amount (rpm) | 2400 | 2750 | 2900 | 2400 | 2150 |
| Trajectory elevation angle T (degree) | 11.1 | 11.1 | 11.1 | 10.9 | 11.3 |
| (T-L) | 0.9 | 1.1 | 1.2 | 0.7 | 0.8 |
| Flight distance (m) | 254.2 | 251.5 | 249.6 | 251.5 | 256.9 |
| Flight performance (2) | | | | | |
| Spin amount (rpm) | 7400 | 7450 | 7550 | 7400 | 7150 |

TABLE 4

| Test item | Example No. 6 | 7 | Comparative Example No. 1 | 2 | 3 |
|---|---|---|---|---|---|
| (Solid center) | | | | | |
| Composition | A | A | A | A | A |
| Deformation amount (mm) | 1.36 | 1.36 | 1.36 | 1.36 | 1.36 |
| Surface hardness $S_D$ (Shore D) | 53 | 53 | 53 | 53 | 53 |
| (Cover) | | | | | |
| Composition | b | c | a | b | d |
| Shore D hardness ($C_D$) | 51 | 54 | 46 | 51 | 58 |
| (Golf ball) | | | | | |
| Dimple total volume $V_T$ ($mm^3$) | 290 | 290 | 310 | 350 | 290 |
| Dimple volume rate $R_V$ (%) | 0.709 | 0.709 | 0.758 | 0.856 | 0.709 |
| ($C_D \times R_V$) | 36.2 | 38.3 | 34.9 | 43.7 | 41.1 |
| ($C_D \times R_V$)/$S_D$ | 0.68 | 0.72 | 0.66 | 0.82 | 0.78 |
| Flight performance (1) | | | | | |
| Launch angle L (degree) | 10.5 | 10.6 | 10.2 | 10.5 | 10.8 |
| Spin amount (rpm) | 2150 | 2050 | 2400 | 2150 | 1950 |
| Trajectory elevation angle T (degree) | 11.5 | 11.4 | 11.7 | 10.8 | 11.5 |
| (T-L) | 1.0 | 0.8 | 1.5 | 0.3 | 0.7 |
| Flight distance (m) | 255.1 | 257.9 | 248.7 | 247.8 | 258.8 |
| Flight performance (2) | | | | | |
| Spin amount (rpm) | 7400 | 7450 | 7550 | 7400 | 7150 |

*Two-piece solid golf ball commercially available from Sumitomo Rubber Industries Ltd.

As is apparent from Table 3 to Table 4, the thread wound golf balls of Examples 1 to 7 of the present invention had longer flight distance than the conventional thread wound golf balls of Comparative Examples. In addition, the thread wound golf balls of Examples 1 to 7 of the present invention also had spin amount when hit by a driver and sand wedge, which is as good as or better than that of the thread wound golf balls of Comparative Examples.

On the other hand, the golf ball of Comparative Example 1 creates blown-up trajectory, which reduces the flight distance, because the product ($C_D \times R_V$) is small. The trajectory of the golf ball of Comparative Example 2 drops, which reduces the flight distance, because the product ($C_D \times R_V$) is large. In the golf ball of Comparative Example 3, the cover hardness is high, and the flight distance is long, but the spin amount when hit by a sand wedge is very low.

What is claimed is:

1. A thread wound golf ball comprising a solid center, a thread rubber layer formed on the solid center, and a cover covering the thread rubber layer, of which the cover has many dimples on the surface thereof, wherein the solid center has a diameter of 35 to 38 mm and a deformation amount of 0.78 to 1.36 mm when applying from an initial load of 9.8 N to a final load of 294 N, the thread rubber layer has a thickness of 1.0 to 2.5 mm, the cover has a Shore D hardness of 40 to 55, and a dimple volume rate $R_V$ (%) and the cover hardness ($C_D$) in Shore D hardness satisfy a correlation represented by the following formula (1):

$$36 \leqq (C_D \times R_V) \leqq 42 \quad (1)$$

wherein the dimple volume rate $R_V$ is represented by the following formula:

$$R_V(\%) = V_T / V_G \times 100$$

wherein $V_T$ ($mm^3$) is a dimple total volume, which is the sum of a volume of a space defined by a concave of the dimple and a tangent plane passed through an opening of the dimple, and $V_G$ is a volume of the golf ball assuming that it is a true sphere having no dimples on the surface thereof.

2. The thread wound golf ball according to claim 1, wherein the solid center has a surface hardness in Shore D hardness of 48 to 60.

3. The thread wound golf ball according to claim 2, wherein the surface hardness of the solid center ($S_D$), the cover hardness ($C_D$) and the dimple volume rate $R_V$ (%) satisfy a correlation represented by the following formula (2):

$$0.67 \leqq (C_D \times R_V)/S_D \leqq 0.79 \quad (2).$$

* * * * *